United States Patent [19]

Arzillo

[11] 4,207,975

[45] Jun. 17, 1980

[54] MAGNETIC SOAP RECEPTACLE

[76] Inventor: Giuliano Arzillo, 8659 Berwyn, Dearborn Heights, Mich. 48127

[21] Appl. No.: 3,104

[22] Filed: Jan. 15, 1979

[51] Int. Cl.[2] ..... A47K 5/08; A47K 5/05

[52] U.S. Cl. ..... 206/77.1; 248/206 A; 206/818; 206/350

[58] Field of Search ..... D6/89; 206/77.1, 350, 206/818; 211/DIG. 1; 248/206 A; 252/90, 92, 174

[56] References Cited

U.S. PATENT DOCUMENTS

| | | | |
|---|---|---|---|
| 609,725 | 8/1898 | Baker | 206/77.1 |
| 2,704,907 | 3/1955 | Durkee | 206/77.1 |
| 2,818,674 | 1/1958 | Hennessy | 206/77.1 X |
| 2,825,177 | 3/1958 | Nordlof et al. | 248/206 A |
| 3,019,549 | 2/1962 | Evans | 206/77.1 |
| 3,472,391 | 10/1969 | Bolognesi | 248/206 A X |

FOREIGN PATENT DOCUMENTS

| | | | |
|---|---|---|---|
| 1112926 | 3/1956 | France | 248/206 A |
| 513958 | 2/1955 | Italy | 211/DIG. 1 |
| 321047 | 6/1957 | Switzerland | 248/206 A |

*Primary Examiner*—Herbert F. Ross

*Attorney, Agent, or Firm*—Cullen, Sloman, Cantor, Grauer, Scott & Rutherford

[57] ABSTRACT

A magnetic soap receptacle comprises a molded housing having a trough base, a pedestal and a hood defining a storage chamber for enclosing a bar of soap. The magnet is disposed within the hood and connected to its top wall. A magnetic insert is embedded within a bar of soap and is registerable with the magnet for supporting and suspending the bar of soap within the hood. The under surface of the magnet is inclined rearwardly and downwardly at an acute angle to provide a similar inclination for the bar of soap to facilitate drainage thereof into the base.

7 Claims, 5 Drawing Figures

FIG. 1
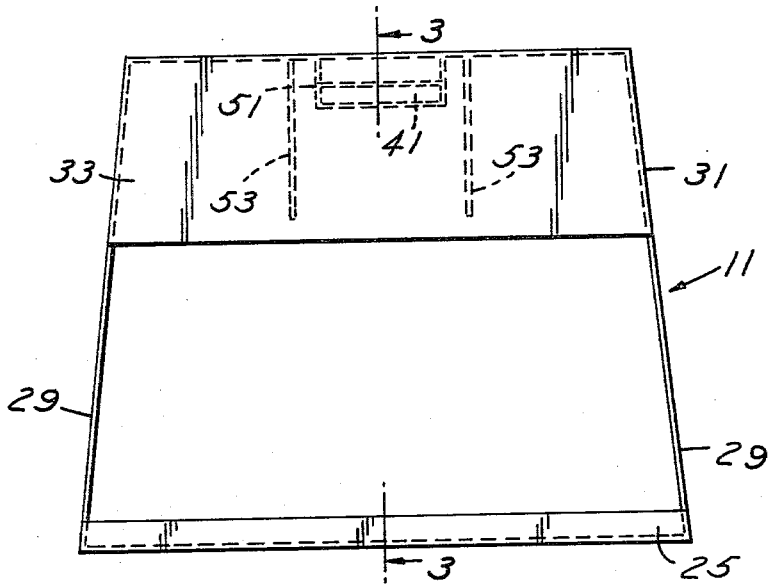
FIG. 2
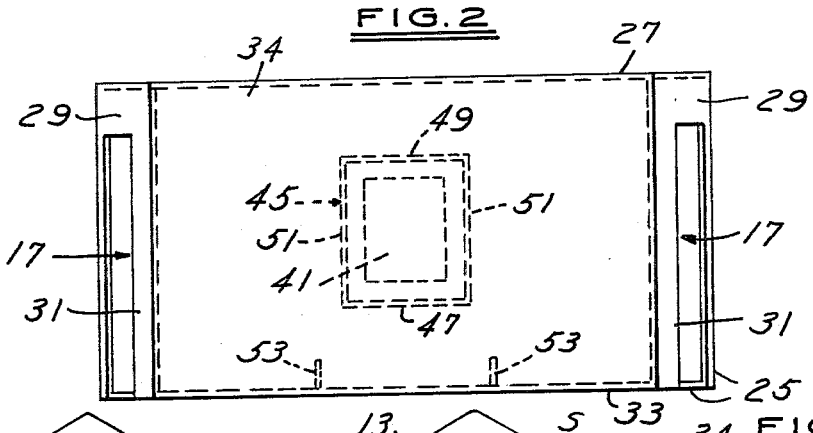
FIG. 3
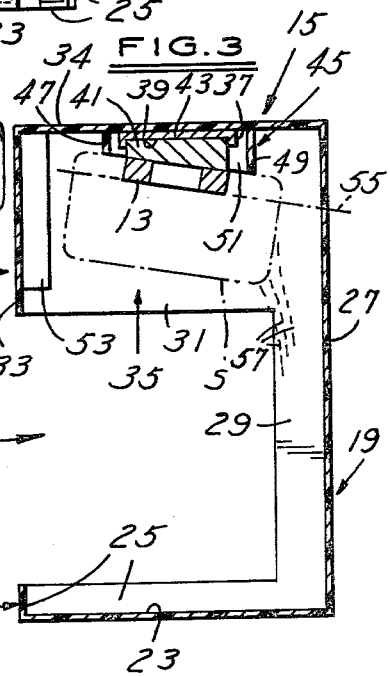
FIG. 4
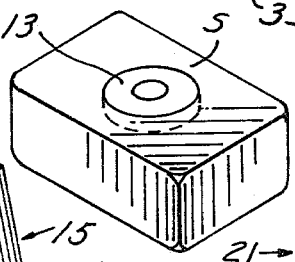
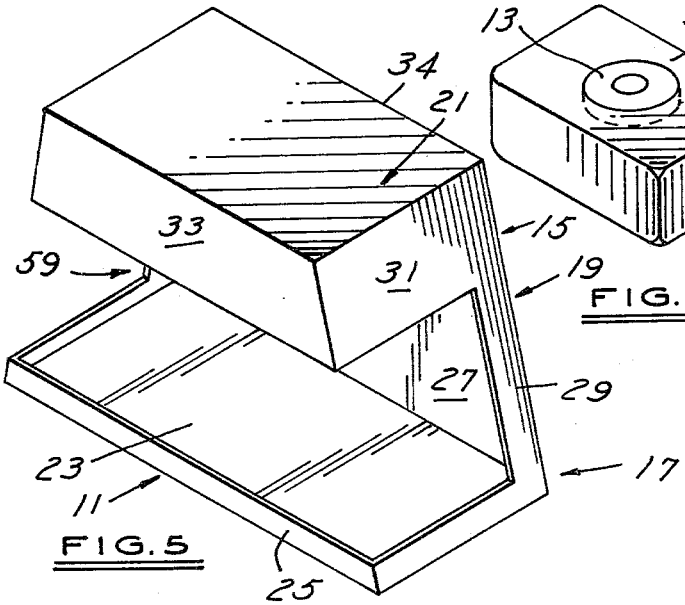
FIG. 5

MAGNETIC SOAP RECEPTACLE

BACKGROUND OF THE INVENTION

Various types of soap storage devices have been heretofore attempted which will support and enclose the bar of soap and to provide for access thereto or for removal of the soap therefrom. Examples of such prior efforts are shown in the following United States Patent:

2,818,674—Dispensing Holder For Bar of Soap
67,408—Soap Holder
1,706,788—Soap Case.

SUMMARY OF THE INVENTION

It is an object of the present invention to provide an improved soap storage receptacle by which the soap may be supported and suspended within the hood of a housing for storage and for suitable drainage and to provide for easy access thereto.

It is another object to provide an improved magnetic soap receptacle which includes a trough-like base, a support pedestal and a hood defining a storage chamber for the bar of soap, and wherein, a magnet is suspended within the hood and is adapted to removably support a bar of soap therein which has a magnetic inert embedded therein.

It is a further object to provide within the hood the rearwardly and downwardly inclined magnet supporting socket to provide a similar inclination for the magnet and a corresponding inclination of the soap when stored to facilitate dripping of accummulated moisture therefrom at the rear lowermost portion of the bar of soap for accummulation within the base trough.

These and other objects will be seen from the following specification and Claims in conjunction with the appended drawing.

THE DRAWING

FIG. 1 is a front elevational view of the present magnetic soap receptacle.

FIG. 2 is a plan view thereof.

FIG. 3 is a vertical section taken in the direction of arrows 3—3 of FIG. 1 with the bar of soap stored within the housing and designated in dash lines.

FIG. 4 is a perspective view of a bar of soap within which is embedded a magnetic insert.

FIG. 5 is a front perspective view of the present soap receptacle.

It will be understood that the above drawing illustrates merely a preferred embodiment of the invention, and that other embodiments are contemplated within the scope of the Claims hereafter set forth.

DETAILED DESCRIPTION OF THE INVENTION

Referring to the drawing, the present magnetic soap receptacle is generally indicated at 11 for supporting and enclosing a bar of soap S within which has been embedded a metallic insert 13, preferably ferrous. Metallic insert 13 may be coated with, as an example, a plastic material to assist in the preventing of rusting of insert 13.

The present soap receptacle includes a molded plastic unitary housing 15 which is mountable upon a wall or other support surface and which includes a base, trough or trough base 17 with a bottom wall 23, a pedestal 19 and a hood 21 upon the pedestal, projecting forwardly thereof and overlying the base. The hood 21 defines a storage chamber 35, FIG. 3, for loosely receiving and suspending and enclosing the bar of soap S. The bottom wall 23 is generally flat and rectangular and is provided with a front edge, a back edge and a pair of side edges.

Trough base 17 includes a continuous side and front wall flange 25 of generally uniform height by which any moisture from the soap may accummulate therein. The flange 25 is secured to the front and side edges of the bottom wall 23 as shown in FIGS. 1 and 3 and extends upwardly from the bottom wall 23 to form therewith and with the back wall a trough for accumulating moisture.

The pedestal includes the upright back wall 27, the upwardly and inwardly inclined side flanges 29 which merge into the upwardly and inwardly inclined side walls 31 of the hood. The back wall 27 is secured to the back edge of the bottom wall 23 and is arranged perpendicular thereto as shown in FIG. 3. The side flanges 29 are each of uniform width. Each flange 29 has the lower portion thereof secured to the flange 25 as shown in FIGS. 3 and 5.

A pair of parallel spaced inwardly directed spacer flanges 53 are mounted upon the interior of the hood front wall 33 and extend towards the back wall insert.

The function of the spacers 53 is to facilitate in guiding and locating the bar of soaps so as to be more closely adjacent the back wall 27, facilitating drainage of moisture, as shown at 57, FIG. 3.

The hood 21 is secured to the pedestal 19 and overlies and is spaced from the bottom wall 23.

The top wall 34 of the hood 21 is flat and is of rectangular configuration, FIG. 3, and has centrally disposed thereunder a magnet holder 37 which opens downwardly. The top wall 34 is parallel to the bottom wall 23. The front wall 33 depends from the top wall 34 and is perpendicular thereto. Front wall 33 is also parallel to the back wall 27. The side walls 31 also depend from the top wall 34 and have their vertical edges secured to the front wall 33 and to the back wall 27 of the pedestal 19.

Socket 39 is formed within the holder 37 and has a base wall which is inclined downwardly and rearwardly with respect to the top wall 34 at an acute angle in the range of 5 to 20 degrees, approximately.

In the preferred embodiment, the angle of inclination is 10 degrees, approximately, though this may be varied as desired.

Magnet 41, of rectangular cross section and preferably a ceramic-type of magnet readily available on the market, has on one side thereof a flat surface adapted for cooperative registry with the base of the socket 39 and adapted for securing therein by a suitable cement or adhesive, as shown at 43.

The other side or under surface of the magnet is planar and lies at a corresponding acute angular inclination with respect to the hood 21 as best shown in FIG. 3, generally along the angular plane 55.

Surrounding the magnet holder 37 and outwardly thereof is a magnet enclosure 45 which depends from the top wall 34 and includes opposing front and rear walls 47,49 and the tapered side walls 51.

The magnet enclosure 45 is of such construction that the marginal lower edge of the enclosure 45 lies in a single similar inclined plane corresponding to plane 55 to, thus, facilitate registry of the bar of soaps within the hood 21 and with respect to the magnet 41.

Thus, the rear wall 49 of the enclosure 45 is of greater height than the front wall 47 and the side walls 51, on their under surfaces, are inclined rearwardly and downwardly as shown in FIG. 3.

While the metallic magnetic insert 13 is shown in the form of a ring, it could be of any other convenient shape such as flat and rectangular. Furthermore, while the insert is shown adjacent one surface of the bar of soaps, it could be further embedded therein and still be magnetically responsive to the magnet 41 for supporting the bar of soap S in the inclined position shown enclosed within the storage chamber 35 of hood 31.

In view of the spacers 53 which project rearwardly of the front wall 33 of the hood 21 placing of the bar of soaps manually projects the soap rearwardly from front wall 33 towards rear wall 27 so that the lowermost transverse edge of the bar of soaps provides a collection point from which excess moisture 57 can drip down adjacent the back wall 27 and adjacent the side flanges 29 into the trough base 17.

Hood 21 overlies and is spaced above and forwardly of the trough base 17 thereby to provide a sufficient transverse entrant passage 59 through which the bar of soaps with magnetic insert 13 may be introduced into the hood or storage chamber 35 and for registry with the magnetic enclosure 45.

The entrant opening 59 also provides for easy manual access to the bar of soaps within the hood 21 for removal thereof, as desired.

The inclination of the magnet 41 and the guide surfaces of the magnetic enclosure 45 also assure that the bar of soaps will be inclined downwardly and rearwardly as shown and in view of the spacers 53, more closely adjacent the rear wall 27 of the pedestal 19.

As best shown in FIGS. 1, 2 and 5, each of the side flanges 29 of the pedestal 19 and the corresponding side wall 31 of the hood 21 lie in a plane which is inclined inwardly and extends upwardly commencing at the trough base 17 and terminating at the top wall 34 of the hood 21.

As an alternative feature, a sponge or sponge-like material may be inserted into the trough base 17 for the purpose of absorbing water and/or soap or the combined water and soap solution which may drip from the magnetically supported bar of soap S.

Having described my invention, reference should now be had to the following Claims:

1. A magnetic soap receptacle comprising a molded unitary housing mountable upon a wall or support surface and including a trough base, a pedestal having a back wall and connected to the base and a hood having a top wall connected to said pedestal and overlying said base, defining a storage chamber for enclosing a bar of soap;

a magnet within said hood underlying and connected to said top wall;

there being a magnetic insert embedded within said bar of soap and registerable with said magnet for supporting and suspending said bar of soap within said hood;

said magnet being rearwardly and downwardly inclined in a plane at an acute angle in the range of 5 to 20 degrees, whereby the bar of soap is similarly inclined to facilitate drainage into said base;

said magnet having a flat under surface which is correspondingly inclined;

said hood including a depending front wall; and a pair of upright parallel spacers mounted upon the interior of said front wall within said chamber and extending toward said back wall for spacing said bar of soap adjacent said back wall.

2. In the receptacle of claim 1, the mounting of said magnet including a downwardly facing socket whose base is inclined at said angle, said magnet being nested within said socket; and means securing said magnet within said socket.

3. In the receptacle of claim 1, a hollow enclosure depending from said top wall outwardly of and surrounding said magnet;

said enclosure having front, rear and side walls whose lower edges lie in a similarly inclined plane for cooperative registry with said bar of soap;

said magnet having a flat under surface lying in said latter-inclined plane.

4. A magnetic soap receptacle comprising a molded unitary housing made from a plastic material and mountable upon a wall or support surface, said housing having an elongated generally flat and rectangular bottom wall provided with a front edge, a back edge and a pair of side edges, a continuous side and front wall flange secured to said front and side edges and extending upwardly from said bottom wall, a pedestal having a vertical back wall which is secured to the back edge of said bottom wall and is arranged perpendicular to said bottom wall, said pedestal extending upwardly from said bottom wall and including a pair of elongated upwardly extending side flanges, each of said side flanges having the lower portion thereof secured to said continuous side and front wall flange, said side and front wall flange and the back wall of said pedestal along with said bottom wall forming a trough base for accumulating moisture, an elongated hood secured to said pedestal, said hood overlying and being spaced from said bottom wall, said hood having a generally flat top wall of rectangular configuration which is parallel to said bottom wall, a front wall depending from said top wall, said front wall of said hood also being arranged parallel to the vertical back wall of said pedestal, and a pair of side walls depending from said top wall and having the vertical edges thereof secured to the front wall of said hood and to the back wall of said pedestal, said hood defining a storage chamber for enclosing a bar of soap, a magnet located with said hood underlying and being connected on one side thereof to said top wall, the other side of said magnet being flat and being rearwardly and downwardly and downwardly inclined in a plane at an acute angle in the range of 5 to 20 degrees, a magnetic insert embedded within the bar of soap and removably registerable with said other side of said magnet for supporting and suspending the bar of soap within said hood at a similar inclination as said other side of said magnet to facilitate drainage of moisture from the bar of soap into the trough base; and a pair of upright elongated and parallel spacers mounted upon the interior of the front wall of said hood within said storage chamber and extending toward said back wall of said pedestal for spacing the bar of soap adjacent said back wall.

5. The magnetic soap receptacle of claim 4, wherein each of the side flanges of said pedestal and the corresponding side wall of said hood lie in a plane which is inclined inwardly and extends upwardly commencing from said trough base and terminating at the top wall of said hood.

6. The magnetic soap receptacle of claim 4, wherein the mounting of said magnet includes a downwardly facing socket which has a base inclined at said acute angle, said magnet being nested within said socket, and means securing said magnet within said socket.

7. The magnetic soap receptacle of claim 4, wherein a hollow enclosure depends from said top wall outwardly of and surrounds said magnet, said hollow enclosure having front, rear and side walls whose lower edges lie in a similarly inclined plane at the acute angle for cooperative registry with the bar of soap.

* * * * *